US006718770B2

(12) United States Patent
Laing et al.

(10) Patent No.: US 6,718,770 B2
(45) Date of Patent: Apr. 13, 2004

(54) FUEL INJECTOR LAMINATED FUEL STRIP

(75) Inventors: Peter Laing, Willow Park, TX (US); Michael Peter Wrubel, Westlake, OH (US); Barry Walford Savel, Summerville, SC (US); Rex Jay Harvey, Mentor, OH (US); Alfred Albert Mancini, Cincinnati, OH (US); James Neil Cooper, Hamilton, OH (US); Robert Thane Mains, Euclid, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/161,911

(22) Filed: Jun. 4, 2002

(65) Prior Publication Data

US 2003/0221429 A1 Dec. 4, 2003

(51) Int. Cl.[7] ..... F02C 1/00; F02G 3/00

(52) U.S. Cl. ..... 60/740; 60/742; 60/747; 239/548

(58) Field of Search ..... 60/740, 741, 742, 60/743, 746, 748; 239/403, 405, 406, 548, 554, 555, 566

(56) References Cited

U.S. PATENT DOCUMENTS

| | | | | | |
|---|---|---|---|---|---|
| 3,612,397 | A | * | 10/1971 | Pearson | 239/127.1 |
| 4,070,826 | A | * | 1/1978 | Stenger et al. | 60/748 |
| 4,735,044 | A | * | 4/1988 | Richey et al. | 60/742 |
| 5,423,178 | A | | 6/1995 | Mains | |
| 5,570,580 | A | | 11/1996 | Mains | |
| 5,577,386 | A | | 11/1996 | Alary et al. | |
| 5,598,696 | A | | 2/1997 | Stotts | |
| 5,761,907 | A | | 6/1998 | Pelletier et al. | |
| 6,021,635 | A | | 2/2000 | Gaag et al. | |
| 6,035,645 | A | * | 3/2000 | Bensaadi et al. | 60/742 |
| 6,076,356 | A | | 6/2000 | Pelletier | |
| 6,082,113 | A | * | 7/2000 | Prociw et al. | 60/748 |
| 6,141,967 | A | * | 11/2000 | Angel et al. | 60/737 |
| 6,276,141 | B1 | | 8/2001 | Pelletier | |
| 6,321,541 | B1 | | 11/2001 | Wrubel et al. | |
| 6,523,350 | B1 | * | 2/2003 | Mancini et al. | 60/740 |
| 2002/0129606 | A1 | * | 9/2002 | Wrubel et al. | 60/740 |

FOREIGN PATENT DOCUMENTS

| | | |
|---|---|---|
| EP | 03253522 | 9/2003 |
| WO | WO 97/34108 | 9/1997 |

* cited by examiner

*Primary Examiner*—Justine R. Yu
*Assistant Examiner*—William H. Rodriguez
(74) *Attorney, Agent, or Firm*—William Scott Andes; Steven J. Rosen

(57) ABSTRACT

A gas turbine engine fuel injector conduit includes a single feed strip having a single bonded together pair of lengthwise extending plates. Each of the plates has a single row of widthwise spaced apart and lengthwise extending parallel grooves. Opposing grooves in each of the plates are aligned forming internal fuel flow passages through the strip from an inlet end to an outlet end. The feed strip includes a substantially straight middle portion between the inlet end and the outlet end. In one alternative, the middle portion has a radius of curvature greater than a length of the middle portion. The feed strip has at least one acute bend between the inlet end and the middle portion and a bend between the outlet end and the middle portion. The feed strip has fuel inlet holes in the inlet end connected to the internal fuel flow passages.

67 Claims, 10 Drawing Sheets

EQUATION 1

FUEL STRIP FORCED DEFLECTION DUE TO THERMAL GROWTH DIFFERENTIAL $$\Delta LTG = LTG\ (\Delta TH\alpha H - \Delta TC\,\alpha X)$$ (.035" IN EXEMPLARY EMBODIMENT)

EQUATION 2

FUEL STRIP DEFLECTION vs. LOAD AND GEOMETRY $$\Delta LTG = P(L1^3+L2^3+L3^3+\ldots+LN^3)\ /\ (3Ebh^3/12)$$

EQUATION 3

FUEL STRIP STRESS DUE TO FORCED DEFLECTION $$\sigma_{max} = 6M_{max}\ /\ (bh^2) \quad \text{WHERE } M_{max} = P(L1)$$

EQUATION 4

<u>SUBSTITUTING AND SOLVING FOR $\sigma_{max}$</u>

$$\sigma_{max} = \frac{3L1EhLTG\ (\Delta TH\,\alpha H - \Delta TC\,\alpha X)}{2\ (L1^3+L2^3+L3^3+\ldots+LN^3)}$$

FIG. 10

NOMENCLATURE $\Delta T$ = CHANGE IN METAL TEMPERATURE FROM ROOM TEMPERATURE TO DESIGN OR MAXIMUM OPERATING TEMPERATURE (TYPICALLY MAX POWER–RT)

$\Delta TH$ = HOT METAL (HOUSING)

$\Delta TC$ = COLD METAL (FUEL STRIP)

$\alpha C$ = COLD METAL THERMAL GROWTH COEFFICIENT $\alpha H$ = HOT METAL THERMAL GROWTH COEFFICIENT $P$ = LOAD DUE TO THERMAL GROWTH DIFFERENTIAL $b$ = FUEL STRIP WIDTH (0.67" IN EXEMPLARY EMBODIMENT)

$h$ = FUEL STRIP THICKNESS (0.108" IN EXEMPLARY EMBODIMENT)

$\sigma_{max}$ = MAX BENDING STRESS (AT FUEL STRIP SURFACE)

$E$ = YOUNG'S MODULUS = 29,300,000 psi (TYPICAL)

$\Delta LTG$ = FUEL STRIP FORCED DEFLECTION $Li$ = BENDING LENGTH, TRANVERSE TO $\Delta$ LTG $i$ = BENDING LENGTH IDENTIFICATION NUMBER $n$ = TOTAL NUMBER OF BENDING LENGTHS $M_i$ = FUEL STRIP BENDING MOMENT = $P(L_i)$

FIG. 11

FUEL INJECTOR LAMINATED FUEL STRIP

BACKGROUND OF THE INVENTION

Field of the Invention

The present invention relates generally to gas turbine engine combustor fuel injectors and, more particularly, to fuel injector conduits having laminated fuel strips.

Fuel injectors, such as in gas turbine engines, direct pressurized fuel from a manifold to one or more combustion chambers. Fuel injectors also prepare the fuel for mixing with air prior to combustion. Each injector typically has an inlet fitting connected to the manifold, a tubular extension or stem connected at one end to the fitting, and one or more spray nozzles connected to the other end of the stem for directing the fuel into the combustion chamber. A fuel conduit or passage (e.g., a tube, pipe, or cylindrical passage) extends through the stem to supply the fuel from the inlet fitting to the nozzle. Appropriate valves and/or flow dividers can be provided to direct and control the flow of fuel through the nozzle. The fuel injectors are often placed in an evenly-spaced annular arrangement to dispense (spray) fuel in a uniform manner into the combustor chamber. An air cavity within the stem provides thermal insulation for the fuel conduit. A fuel conduit is needed that can be attached to a valve housing and to the nozzle. The fuel conduit should be tolerant of low cycle fatigue (LCF) stresses caused by stretching of the conduit which houses the conduit and which undergoes thermal growth more than the cold conduit. The attachment of the conduit to the valve housing should be a reliable joint which does not leak during engine operation. Fuel leaking into the hot air cavity can cause detonations and catastrophic over pressures.

A fuel injector typically includes one or more heat shields surrounding the portion of the stem and nozzle exposed to high temperature compressor discharge air. The heat shields are used for thermal insulation from the hot compressor discharge air during operation. This prevents the fuel from breaking down into solid deposits (i.e., "coking") which occurs when the wetted walls in a fuel passage exceed a maximum temperature (approximately 400° F. (200° C.) for typical jet fuel). The coke in the fuel nozzle can build up and restrict fuel flow through the fuel nozzle rendering the nozzle inefficient or unusable. One such heat shield assembly is shown in U.S. Pat. No. 5,598,696 and includes, a pair of U-shaped heat shield members secured together to form an enclosure for the stem portion of the fuel injector. At least one flexible clip member secures the heat shield members to the injector at about the midpoint of the injector stem. The upper end of the heat shield is sized to tightly receive an enlarged neck of the injector to prevent the compressor discharge air from flowing between the heat shield members and the stem. The clip member thermally isolates the heat shield members from the injector stem. The flexibility of the clip member permits thermal expansion between the heat shield members and the stem during thermal cycling, while minimizing the mechanical stresses at the attachment points.

Another stem and heat shield assembly is shown in U.S. Pat. No. 6,076,356 disclosing a fuel tube completely enclosed in the injector stem such that a stagnant air gap is provided around the tube. The fuel tube is fixedly attached at its inlet end and its outlet end to the inlet fitting nozzle, respectively, and includes a coiled or convoluted portion which absorbs the mechanical stresses generated by differences in thermal expansion of the internal nozzle component parts and the external nozzle component parts during combustion and shut-down. Many fuel tubes also require secondary seals (such as elastomeric seals) and/or sliding surfaces to properly seal the heat shield to the fuel tube during the extreme operating conditions occurring during thermal cycling. Such heat shield assemblies as described above require a number of components, and additional manufacturing and assembly steps, which can increase the overall cost of the injector, both in terms of original purchase as well as a continuing maintenance. In addition, the heat shield assemblies can take up valuable space in and around the combustion chamber, block air flow to the combustor, and add weight to the engine. This can all be undesirable with current industry demands requiring reduced cost, smaller injector size ("envelope") and reduced weight for more efficient operation.

More conventional nozzles employ primary and secondary nozzles in which only the primary nozzles are used during start-up. Both nozzles are used during higher power operation. The flow to the secondary nozzles is reduced or stopped during start-up and lower power operation. Fuel injectors having pilot and main nozzles have been developed for staged combustion. Primary and secondary nozzles discharge at approximately the same axial location in the combustor. Fuel injectors having main and pilot nozzles have been developed for more efficient and cleaner-burning, as the fuel flow can be more accurately controlled and the fuel spray more accurately directed for the particular combustor requirement. Fuel injectors having main and pilot nozzles use multiple fuel circuits discharging into different axial and radial locations in the combustion air flow field to provide good air and fuel mixing at high power. At low power some of the circuits are turned off to maintain a locally higher fuel/air ratio at the remaining fuel injection locations. The circuits and nozzles which are turned off at low power are referred to as main circuits and main nozzles. The circuits and nozzles which are left let on to keep the combustion flame from extinguishing are referred to as pilot circuits and pilot nozzles. The pilot and main nozzles can be contained within the same nozzle stem assembly or can be supported in separate nozzle assemblies. Dual nozzle fuel injectors can also be constructed to allow further control of the fuel for dual combustors, providing even greater fuel efficiency and reduction of harmful emissions.

A typical technique for routing fuel through the stem portion of the fuel injector is to provide a fuel conduit having concentric passages within the stem, with the fuel being routed separately through different passages. The fuel is then directed through passages and/or annular channels in the nozzle portion of the injector to the spray orifice(s). U.S. Pat. No. 5,413,178, for example, discloses concentric passages where the pilot fuel stream is routed down and back along the main nozzle for cooling purposes. This can also require a number of components and additional manufacturing and assembly steps, which can all be contrary to desirable cost and weight reduction and small injector envelope.

U.S. Pat. No. 6,321,541 addresses these concerns and drawbacks with a fuel injector that includes an inlet fitting, a stem connected at one end to the inlet fitting, and one or more nozzle assemblies connected to the other end of the stem and supported at or within the combustion chamber of the engine. A fuel conduit in the form of a single elongated laminated feed strip extends through the stem to the nozzle assemblies to supply fuel from the inlet fitting to the nozzle(s) in the nozzle assemblies. An upstream end of the feed strip is directly attached (such as by brazing or welding) to the inlet fitting without additional sealing components (such as elastomeric seals). A downstream end of the feed strip is connected in a unitary (one piece) manner to the nozzle. The single feed strip has convolutions along its length to provide increased relative displacement flexibility along the axis of the stem and reduce stresses caused by differential thermal expansion due to the extreme temperatures the nozzle is exposed to. This reduces or eliminates a need for additional heat shielding of the stem portion of the injector.

The laminate feed strip and nozzle are formed from a plurality of plates. Each plate includes an elongated, feed strip portion and a unitary head (nozzle) portion, substantially perpendicular to the feed strip portion. Fuel passages and openings in the plates are formed by selectively etching the surfaces of the plates. The plates are then arranged in surface-to-surface contact with each other and fixed together such as by brazing or diffusion bonding, to form an integral structure. Selectively etching the plates allows multiple fuel circuits, single or multiple nozzle assemblies and cooling circuits to be easily provided in the injector. The etching process also allows multiple fuel paths and cooling circuits to be created in a relatively small cross-section, thereby, reducing the size of the injector.

The feed strip portion of the plate assembly is mechanically formed such as by bending to provide the convoluted form. In one embodiment, the plates all have a T-shape in plan view. In this form, the head portions of the plate assembly can be mechanically formed into a cylinder having an annular cross-section, or other appropriate shape. The ends of the head can be spaced apart from one another or can be brought together and joined, such as by brazing or welding. Spray orifices are provided on the radially outer surface, radially inner surface and/or ends of the cylindrical nozzle to direct fuel radially outward, radially inward and/or axially from the nozzle.

It is desirable to have a fuel conduit that is more flexible, has less bending stress and, is therefore, less susceptible to low cycle fatigue than previous feed strip designs. It is also desirable to have a feed strip with good relative displacement flexibility along the axis of the stem and that reduce stresses caused by differential thermal expansion due to the extreme temperatures to which the nozzle is exposed. It is also desirable to have a feed strip that provides a smaller envelope for the heat shield which, in turn, has a small circumferential width in the flow and lower drag and associated flow losses making for a more aerodynamically efficient design.

BRIEF DESCRIPTION OF THE INVENTION

A fuel injector conduit includes a single feed strip having a single bonded together pair of lengthwise extending plates. Each of the plates has a single row of widthwise spaced apart and lengthwise extending parallel grooves. The plates are bonded together such that opposing grooves in each of the plates are aligned forming internal fuel flow passages through the length of the strip from an inlet end to an outlet end.

The feed strip includes a radially extending substantially straight middle portion between the inlet end and the outlet end. A straight header of the fuel injector conduit extends transversely (in an axially aftwardly direction) away from the outlet end of the middle portion and leads to an annular main nozzle. Radial thermal growth of the feed strip is accommodated by deflection of bending arms of the strip that are fully or partially transverse to or deflect substantially transversely to the middle portion. The straight header is a first bending arm A1 and it is the longest of the bending arms.

In the exemplary embodiment of the invention, the middle portion is slightly bowed and has a radius of curvature greater than a length of the middle portion. The middle portion is slightly bowed for ease of installation.

In the exemplary embodiment of the invention, the feed strip has at least one acute bend between the inlet end and the middle portion and a bend between the outlet end and the middle portion. The acute bend has radially inner and outer arms, respectively having second and third bending arm lengths. The inner and outer arms are angularly spaced apart by an acute angle. The second and third bending arm lengths are fully or partially transverse to or deflect substantially transversely to the middle portion. The feed strip has fuel inlet holes in the inlet end connected to the internal fuel flow passages. The inlet end is fixed within a valve housing.

In a further embodiment of the invention, the annular main nozzle is fluidly connected to the outlet end of the feed strip and integrally formed with the feed strip from the single bonded together pair of lengthwise extending plates. The internal fuel flow passages extend through the feed strip and the annular main nozzle. Annular legs extend circumferentially from at least a first one of the internal fuel flow passages through the main nozzle. Spray orifices extend from the annular legs through at least one of the plates. The annular legs may have waves. The annular legs may include clockwise and counterclockwise extending annular legs. The clockwise and counterclockwise extending annular legs may have parallel first and second waves, respectively, and the spray orifices may be located in alternating ones of the first and second waves so as to be substantially aligned along a circle.

In a more detailed embodiment, the conduit includes a pilot nozzle circuit which includes clockwise and counterclockwise extending pilot legs extending circumferentially from at least a second one of the internal fuel flow passages through the main nozzle.

The invention includes a fuel injector including an upper valve housing, a hollow stem depending from the housing, at least one fuel nozzle assembly supported by the stem, and the fuel injector conduit extending between the housing through the stem to the nozzle assembly. The injector may further include a main mixer having an annular main housing with openings aligned with the spray orifices. An annular cavity is defined within the main housing and the main nozzle is supported by the main housing within the annular cavity. An annular slip joint seal is disposed in each set of the openings aligned with each one of the spray orifices. The housing may include inner and outer heat shields and the inner heat shield may further include inner and outer walls and an annular gap therebetween such that the openings pass through the inner and outer heat shields. The annular slip joint seal may be attached to the inner wall of the inner heat shield.

The invention also provides a fuel injector having an annular main nozzle, a main mixer having an annular main housing with openings aligned with spray orifices in a main nozzle, and an annular cavity defined within the main housing. The main nozzle is received within the annular cavity and an annular slip joint seal is disposed in each set of the openings aligned with each one of the spray orifices. The housing may further include inner and outer heat shields, respectively, and the inner heat shield may include inner and outer walls with an annular gap therebetween. The openings may pass through the inner and outer heat shields, 196) and the annular slip joint seal may be attached to the inner wall of the inner heat shield.

The feed strip of the present invention has good relative displacement flexibility along the axis of the stem and low stresses caused by differential thermal expansion due to the extreme temperatures to which the nozzle is exposed. The present invention provides for a fuel conduit that allows the use of a smaller envelope for hollow stem which serves as a heat shield for the conduit. The hollow stem, in turn, has a small circumferential width in the flow and, therefore, lowers drag and associated flow losses making for a more aerodynamically efficient design.

BRIEF DESCRIPTION OF THE DRAWINGS

FIG. 10 is an illustration of equations used to analyze thermal growth force in the fuel strip in FIG. 9.

FIG. 11 is an illustration of definitions of parameters used in equations in FIG. 10.

DETAILED DESCRIPTION OF THE INVENTION

Figure 1:
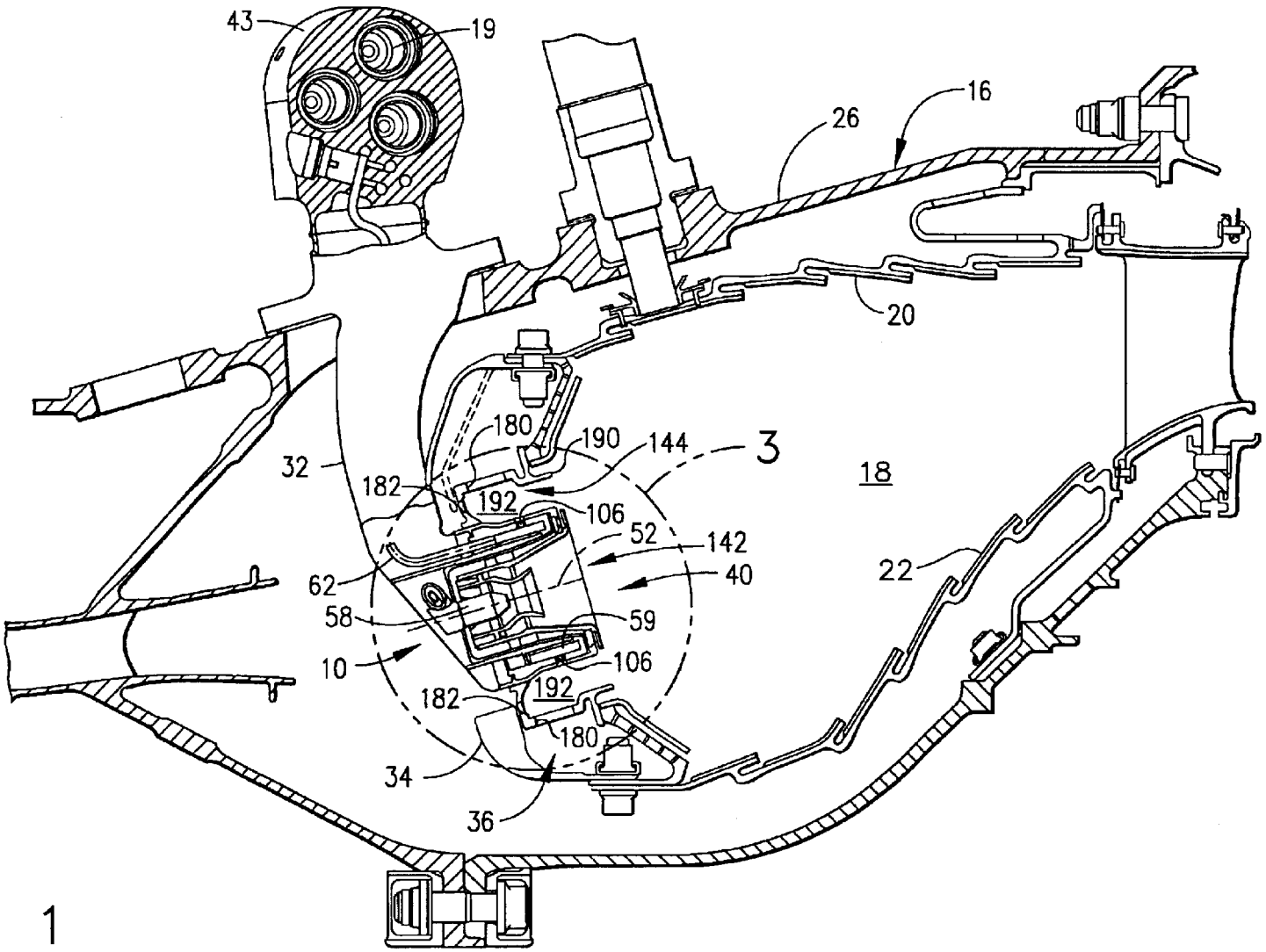
FIG. 1 is a cross-sectional view illustration of a gas turbine engine combustor with an exemplary embodiment of a fuel injector having a fuel strip of the present invention.

Illustrated in FIG. 1 is an exemplary embodiment of a combustor 16 including a combustion zone 18 defined between and by annular, radially outer and radially inner liners 20 and 22, respectively. The outer and inner liners 20 and 22 are located radially inwardly of an annular combustor casing 26 which extends circumferentially around outer and inner liners 20 and 22. The combustor 16 also includes an annular dome 34 mounted upstream from outer and inner liners 20 and 22. The dome 34 defines an upstream end 36 of the combustion zone 18 and a plurality of mixer assemblies 40 (only one is illustrated) are spaced circumferentially around the dome 34. Each mixer assembly 40 supports pilot and main nozzles 58 and 59, respectively, and together with the pilot and main nozzles deliver a mixture of fuel and air to the combustion zone 18. Each mixer assembly 40 has an axis of revolution 52 about which the pilot and main nozzles 58 and 59 are circumscribed.

Figure 2:
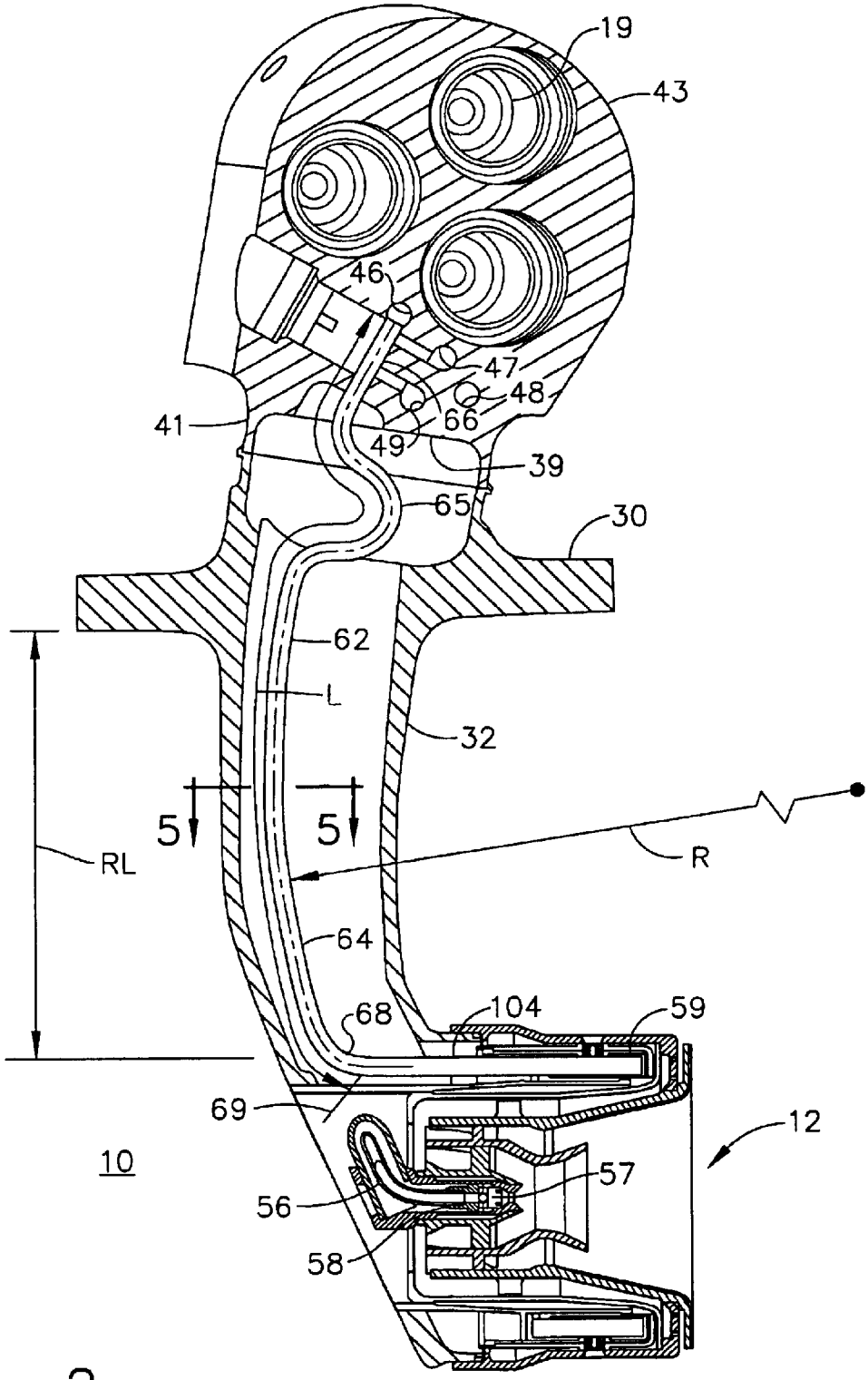
FIG. 2 is an enlarged cross-sectional view illustration of the fuel injector in FIG. 1.

Referring to FIGS. 1 and 2, an exemplary embodiment of a fuel injector 10 of the present invention has a fuel nozzle assembly 12 (more than one radially spaced apart nozzle assemblies may be used) that includes the pilot and main nozzles 58 and 59, respectively, for directing fuel into the combustion zone of a combustion chamber of a gas turbine engine. The fuel injector 10 includes a nozzle mount or flange 30 adapted to be fixed and sealed to the combustor casing 26. A hollow stem 32 is integral with or fixed to the flange 30 (such as by brazing or welding) and supports the fuel nozzle assembly 12 and the mixer assembly 40.

The hollow stem 32 has an inlet assembly 41 disposed above or within an open upper end of a chamber 39 and is integral with or fixed to flange 30 such as by brazing. Inlet assembly 41 may be part of a valve housing 43 with the hollow stem 32 depending from the housing. The housing 43 is designed to be fluidly connected to a fuel manifold 44 illustrated schematically in FIG. 7 to direct fuel into the injector 10. The inlet assembly 41 is operable to receive fuel from the fuel manifold 44. The inlet assembly 41 includes fuel valves 45 to control fuel flow through fuel circuits 102 in the fuel nozzle assembly 12.

The inlet assembly 41 as illustrated in FIG. 2 is integral with or fixed to and located radially outward of the flange 30 and houses fuel valve receptacles 19 for housing the fuel valves 45. The nozzle assembly 12 includes the pilot and main nozzles 58 and 59, respectively. Generally, the pilot and main nozzles 58 and 59 are used during normal and extreme power situations while only the pilot nozzle is used during start-up and part power operation. A flexible fuel injector conduit 60 having a single elongated feed strip 62 is used to provide fuel from the inlet assembly 41 to the nozzle assembly 12. The feed strip 62 is a flexible feed strip formed from a material which can be exposed to high temperatures, such as during brazing in a manufacturing process, without being adversely affected.

Figure 3:
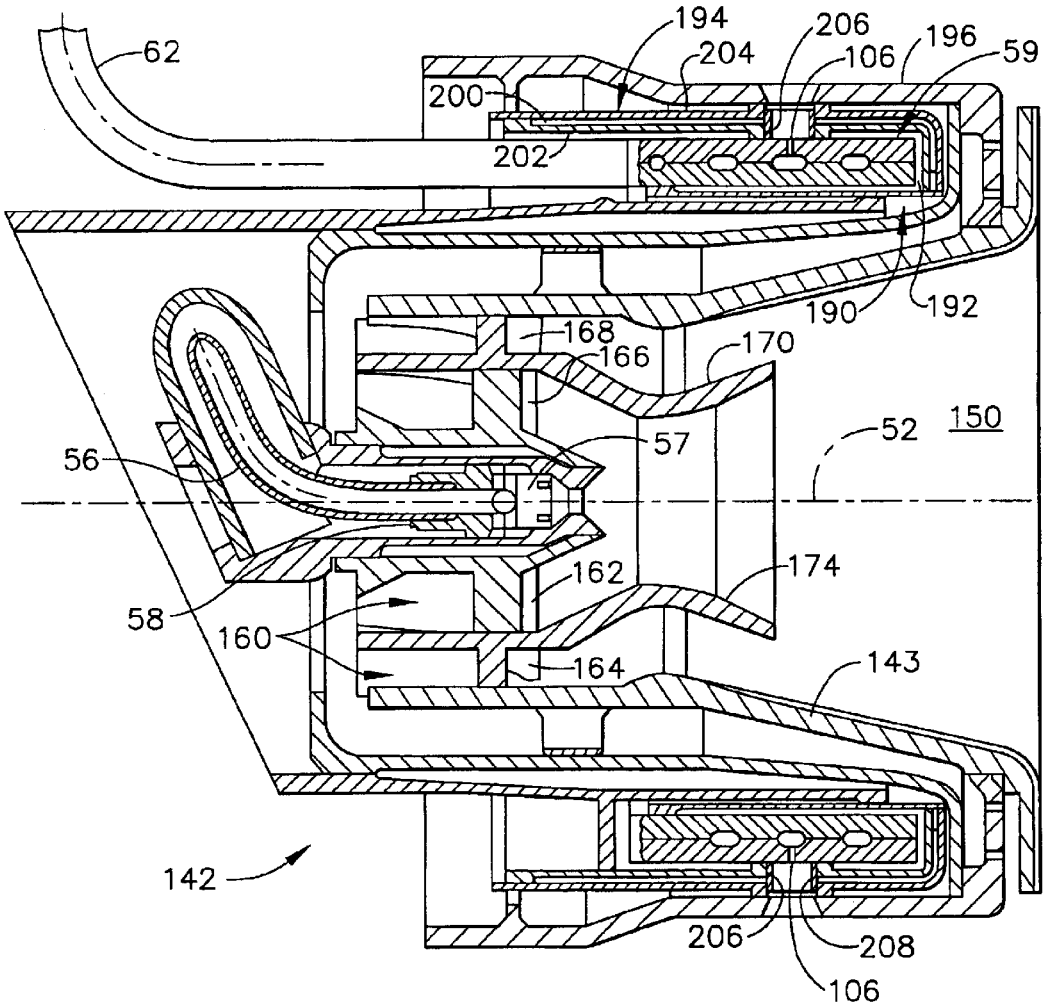
FIG. 3 is an enlarged cross-sectional view illustration of a fuel nozzle assembly in a mixer assembly in FIG. 2.
Figure 4:
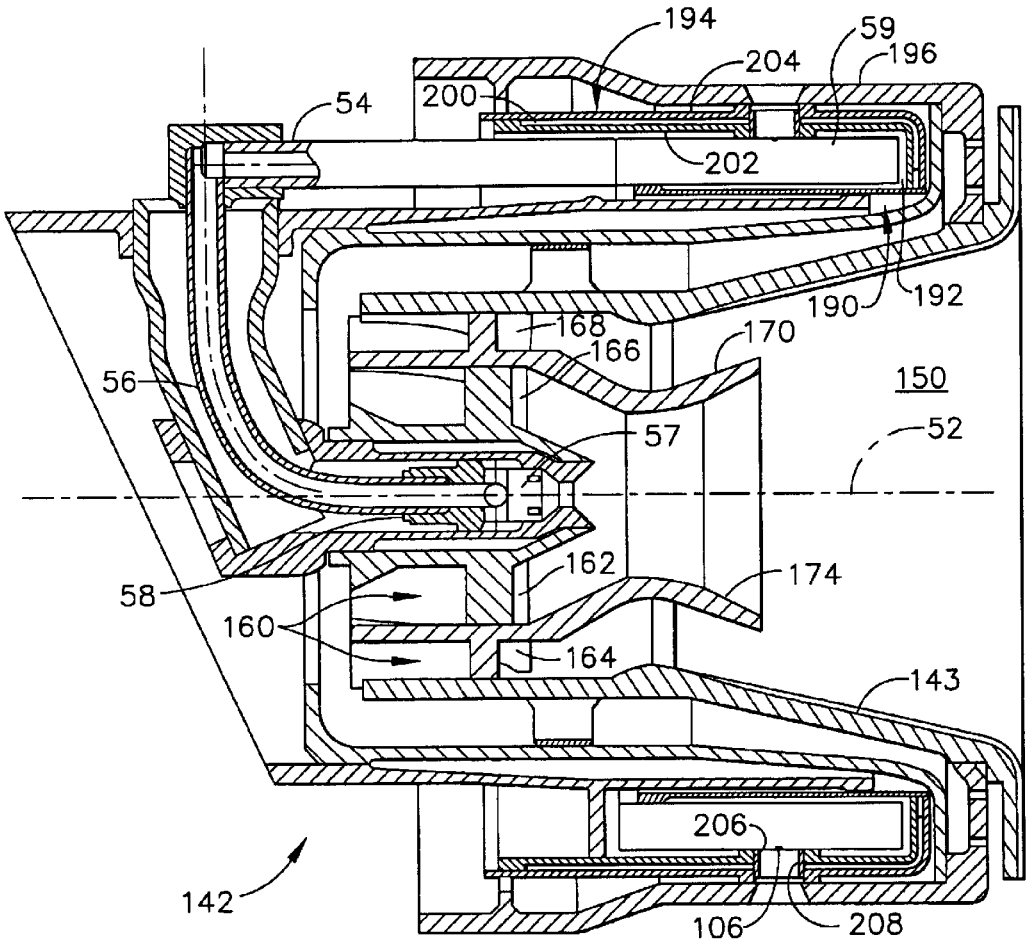
FIG. 4 is an enlarged cross-sectional view illustration taken at a second angle through the fuel nozzle assembly in FIG. 2.
Figure 5:
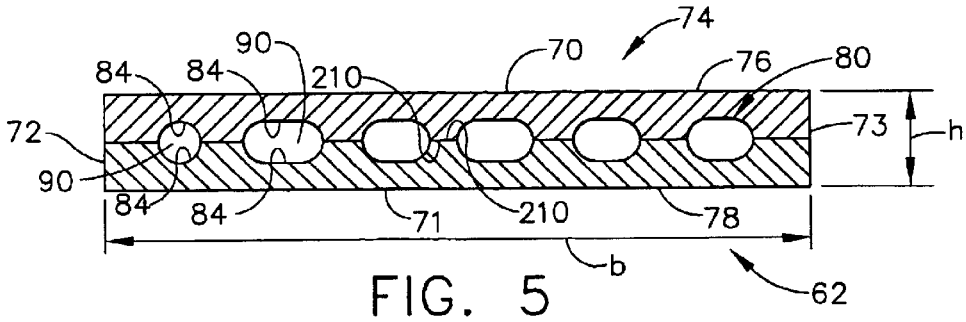
FIG. 5 is a cross-sectional view illustration of the fuel strip taken though 5—5 in FIG. 2.
Figure 6:
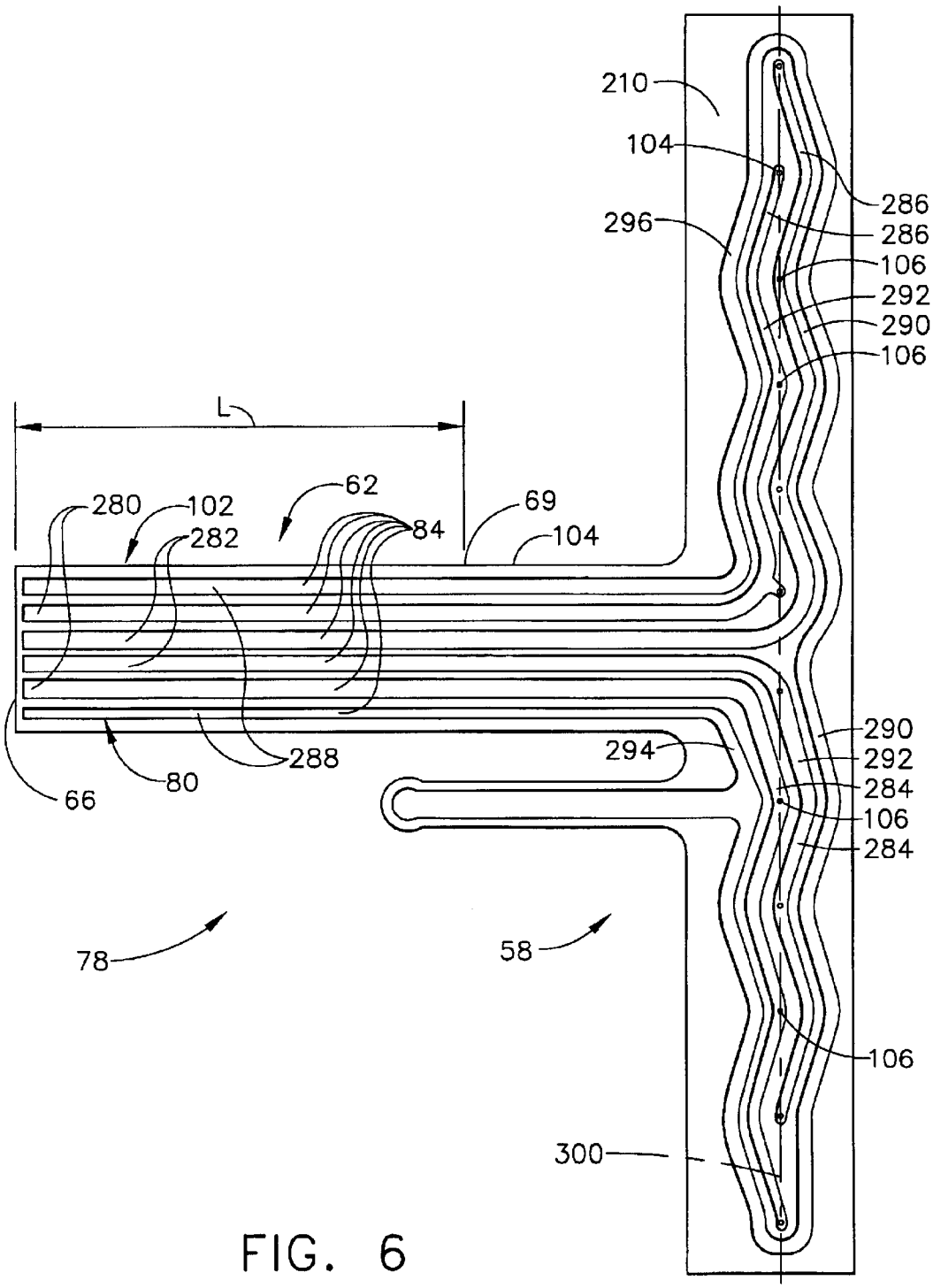
FIG. 6 is a top view illustration of a plate used to form the fuel strip in FIG. 1.
Figure 8:
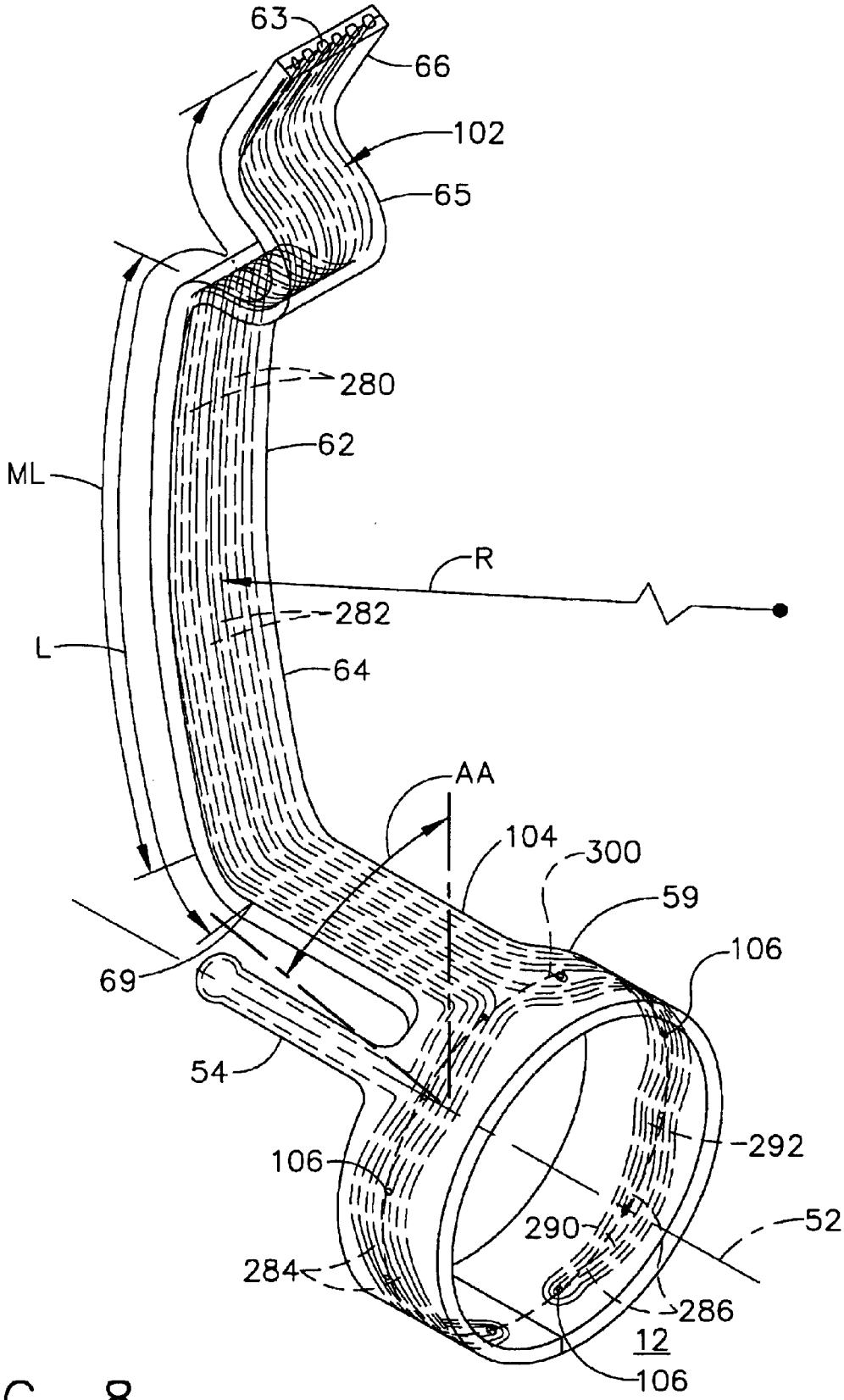
FIG. 8 is a perspective view illustration of the fuel strip with the fuel circuits in FIG. 7.

Referring to FIGS. 5 and 6, the feed strip 62 has a single bonded together pair of lengthwise extending first and second plates 76, 78. Each of the first and second plates 76, 78 has a single row 80 of widthwise spaced apart and lengthwise extending parallel grooves 84. The plates are bonded together such that opposing grooves 84 in each of the plates are aligned forming internal fuel flow passages 90 through the length L of the feed strip 62 from an inlet end 66 to an outlet end 69 of the feed strip 62. A pilot nozzle extension 54 extends aftwardly from the main nozzle 59 and is fluidly connected to a fuel injector tip 57 of the pilot nozzle 58 by the pilot feed tube 56 as further illustrated in FIG. 4. The feed strip 62 feeds the main nozzle 59 as illustrated in FIG. 3. Referring to FIGS. 4 and 8, the pilot nozzle extension 54 and the pilot feed tube 56 are generally angularly separated about the axis of revolution 52 by an angle AA illustrated in FIG. 8.

Figure 9:
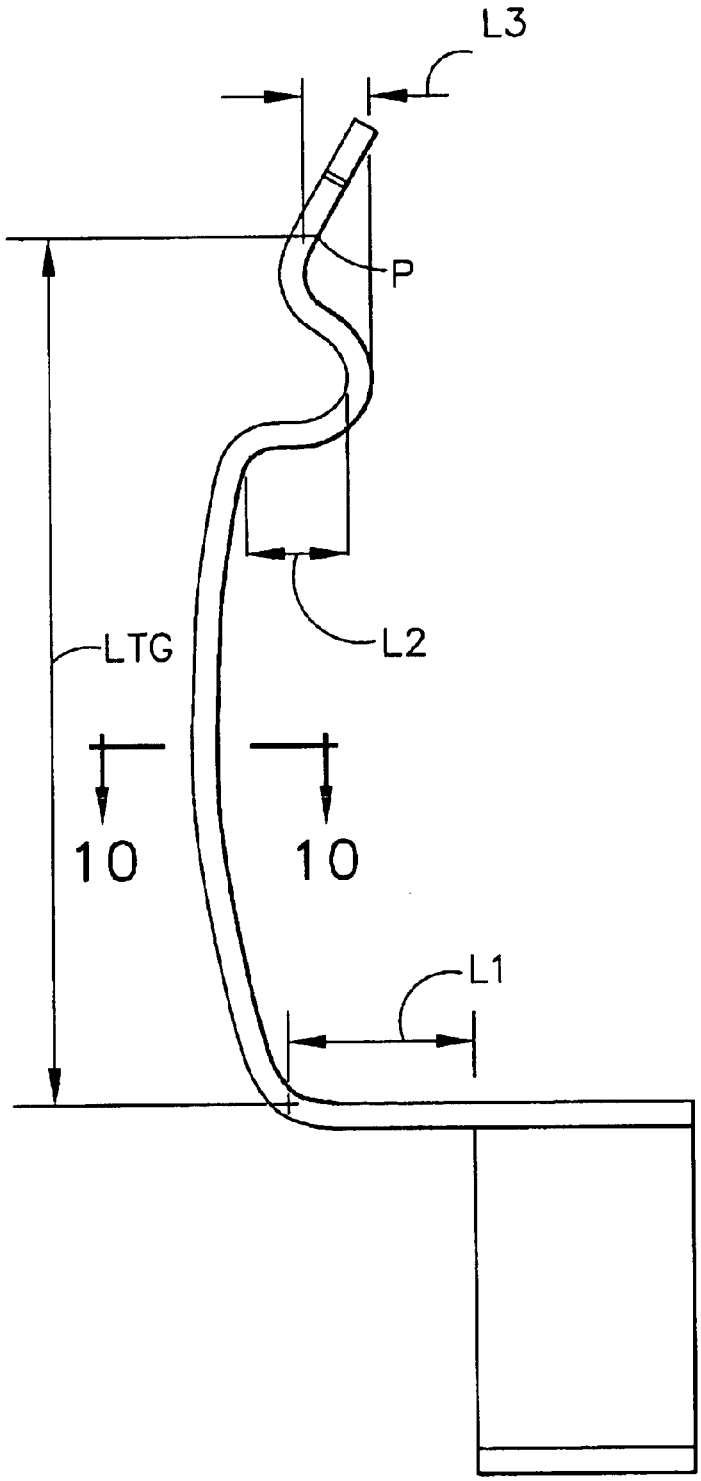
FIG. 9 is a schematic illustration of the fuel strip in FIG. 1.

Referring to FIGS. 2 and 8, the fed strip 62 has a substantially straight radially extending middle portion 64 between the inlet end 66 and the outlet end 69. The middle portion 64 extends radially through the entire radial length RL of the hollow stem 32. A straight header 104 of the fuel injector conduit 60 extends transversely (in an axially aftwardly direction) away from the outlet end 69 of the middle portion 64 and leads to an annular main nozzle 59 which is secured thus preventing deflection. Referring to FIG. 9, a thermal growth length LTG of the feed strip 62 is subject to radial thermal growth which is accommodated by deflection of bending arms AN of the strip that are fully or partially transverse to or deflect substantially transversely to the middle portion 64. The longest of the bending arms AN is denoted as a first bending arm A1 and is the straight header 104. The bending arms AN have bending arm moment lengths LN that are fully or partially transverse to the middle portion 64 and first bending arm A1 has a bending arm moment length L1.

In the exemplary embodiment of the invention illustrated herein, the middle portion 64 is slightly bowed and has a radius of curvature R greater than a middle portion length ML of the middle portion 64 as illustrated in FIGS. 8 and 9. The illustrated embodiment of the invention also includes at least one acute bend 65 between the inlet end 66 and the middle portion 64 and a bend 68 between the middle portion 64 and the outlet end 69. The acute bend 65 has radially inner and outer arms 75 and 77, respectively, which operate as second and third bending arms A2 and A3, that are fully or partially transverse to or deflect substantially transversely to the middle portion 64. The inner and outer arms 75 and 77 are angularly spaced apart by an acute angle 79. The second and third bending arms A2 and A3 have second and third bending arm lengths L2 and L3. The second and third transverse bending arms A2 and A3 have respective second and third transverse bending arm moment lengths L2 and L3 transverse to and operable to deflect substantially transversely to the middle portion 64. The bend 68 transitions the strip 62 from the middle portion 64 to a header 104 of the fuel injector conduit 60. The inlet end 66 is fixed and restrained from thermal growth induced movement within a valve housing 43.

The fuel injector conduit 60 is designed to have a maximum allowable low cycle fatigue LCF stress. LCF life analysis of thermal-strain induced stress should be conducted to determine a LCF maximum stress SM. One such LCF life analysis is to use strain controlled LCF data. Cyclic material testing is performed using the same peak strain on each cycle. This mimics the thermal stress vs. strain situation on the actual part. Overall peak strain is constant for a given thermal cycle while actual peak stress decreases with localized plastic flow. Present day methods include use of load controlled LCF data for rotating parts in which the peak stress is driven more by centrifugal acceleration and for pressure vessels in which peak stress may be driven by pressure. The load control cyclic test keeps load constant on each cycle so that local peak stress is constant or even increasing as plastic flow occurs and the net cross-sectional area decreases. This mimics those applications because in both cases, the load (centrifugal and/or pressure) is typically not relieved and is constant as plastic flow occurs. The fuel injector conduit 60 is life limited by thermal strain, thus, strain controlled data should be used for life cycle analyses.

One method to perform thermal strain LCF life analysis is to use the average of a pseudo-elastic stress range [(maximum stress—minimum stress)/2] as a mean stress, and (maximum stress—mean stress) as an alternating stress. An A Ratio is defined as the (alternating stress)/(mean stress), and for most metals, the most severe cycle for a given alternating stress is for the A Ratio=infinity (i.e. zero mean stress and thus complete stress reversal). LCF data is typically obtained at different temperatures for A=+1 and A=infinity, and is occasionally available at other A ratios. The data is presented in the form of cycles to crack initiation (x-axis) vs. alternating pseudo-elastic stress (y-axis) see FIG. 10. Inconel 600 is one material presently being studied for use. The data illustrated in FIG. 10 is an estimate for Inconel 625 at 250 degrees F. The material properties related to this invention for Inconel 600 are thought to be similar to those of Inconel 625. The data is in statistical format, i.e. an average curve CA, a −3sigma curve C3, and a 95/99 curve C9. The 95/99 curve represents a worst-case material and is typically used for design purposes. The 95/99 curve represents the stress level that will not result in crack initiation for the given amount of cycles for 99% of coupons tested, with 95% confidence level. This curve is typically −5 to −6 sigma below the average curve.

A stretch design goal for engine cold parts such as may be found on a CFM56 cold parts is 3 service intervals of 15,000 full thermal cycles (FTCs) each, which represents over 20 years of service. As a conservative approach, the worse case FTC is assumed to occur on every flight, and a goal of 50,000 cycles, with 50% stress margin is used in the exemplary analysis. This is equivalent to an alternating pseudo-stress less than 67% of the 95/99 value (65 ksi) at 50,000 cycles. Therefore, for IN625 the peak concentrated allowable bending stress omax is 2×43.5 or 87 ksi. The following equation relates the peak concentrated allowable bending stress omax, which is not to be exceeded, to the bending arm lengths LN, thickness H, hot metal temperature TH of the housing, and the cold metal temperature TC of the feed strip 62 illustrated schematically in FIG. 9 for a given material of the feed strip.

$$\sigma\text{MAX} = \frac{3xL1xExHxLTGx(THx\alpha H - TCx\alpha C)}{2x(L_1^3 + L_2^3 + \ldots\ LN^3)}$$

The above equation for the allowable bending stress omax, equation 4 in FIG. 10, was developed using an analysis of the radial thermal growth of the thermal growth length LTG of the feed strip 62 as illustrated by equations 1–3 in FIG. 10. The nomenclature defining and explaining parameters used in the equations in FIG. 10 are listed in FIG. 11. Equation 1 defines a change |LTG of the thermal growth length LTG of the feed strip 62 due to thermal growth. The change |LTG is in terms of change from room temperature to design operating conditions difference between the hot housing denoted by TH and the colder feed strip 62. The inlet end 66 is fixed and restrained from thermal growth induced movement within the valve housing 43. The bending arms AN deflect in total an amount equal to the change |LTG in the thermal growth length LTG of the feed strip 62 as illustrated in equation 2 in FIG. 10. Equation 3 in FIG. 10 defines a relationship between the peak concentrated allowable bending stress omax which would occur in the first bending arm A1 which has a bending arm moment length L1. The equation for the allowable bending stress omax, equation 4 in FIG. 10, from equations 1 through 3. The bending arm moment lengths LN are chosen such that omax in equation 4 does not exceed a predetermined design value based on design considerations disclosed above which in the exemplary embodiment is about 87 ksi.

The header 104 is generally parallel to the axis of revolution 52 and leads to the main nozzle 59. The shape of the feed strip 62 and, in particular, the middle portion 64 allows expansion and contraction of the feed strip in response to thermal changes in the combustion chamber, while reducing mechanical stresses within the injector. The shape of the feed strip helps reduce or eliminate the need for additional heat shielding of the stem portion in many applications, although in some high-temperature situations an additional heat shield may still be necessary or desirable.

Referring to FIGS. 5 and 8, the term strip means that the feed strip 62 has an elongated essentially flat shape with first and second side surfaces 70 and 71 that are substantially parallel and oppositely facing from each other. In the embodiment illustrated herein, the strip 62 includes substantially parallel oppositely-facing first and second edges 72 and 73 that are substantially perpendicular to the first and second side surfaces 70 and 71. The strip has a rectangular shape 74 in cross-section (as compared to the cylindrical shape of a typical fuel tube), although this shape could vary depending upon manufacturing requirements and techniques. The feed strip may have a sufficient radius of curvature R of the middle portion 64 to allow the strip to easily be inserted and withdrawn from the hollow stem 32 without providing undue stress on the strip. The strip should be sized so as to prevent or avoid causing the strip to exhibit resonant behavior in response to combustion system stimuli. The strip's shape and size appropriate for the particular application can be determined by experimentation and analytical modeling and/or resonant frequency testing.

Referring to FIGS. 2 and 8, the inlets 63 at the inlet end 66 of the feed strip 62 are in fluid flow communication or fluidly connected with first, second, third, or fourth inlet ports 46, 47, 48, and 49, respectively, in the inlet assembly 41 to direct fuel into the feed strips. The inlet ports feed the multiple internal fuel flow passages 90 down the length L of the feed strip 62 to the pilot nozzle 58 and main nozzle 59 in the nozzle assembly 12 as well as provide cooling circuits for thermal control in the nozzle assembly. The header 104 of the nozzle assembly 12 receives fuel from the feed strip 62 and conveys the fuel to the main nozzle 59 and, where incorporated, to the pilot nozzle 58 through the fuel circuits 102 as illustrated in FIGS. 7 and 8.

In the exemplary embodiment of the invention illustrated herein, the feed strip 62, the main nozzle 59, and the header 104 therebetween are integrally constructed from the lengthwise extending first and second plates 76 and 78. The main nozzle 59 and the header 104 may be considered to be elements of the feed strip 62. The fuel flow passages 90 of the fuel circuits 102 run through the feed strip 62, the header 104, and the main nozzle 59. The fuel passages 90 of the fuel circuits 102 lead to spray orifices 106 and through the pilot nozzle extension 54 which is operable to be fluidly connected to the pilot feed tube 56 to feed the pilot nozzle 58 as illustrated in FIG. 4. The parallel grooves 84 of the fuel flow passages 90 of the fuel circuits 102 are etched into adjacent surfaces 210 of the first and second plates 76 and 78 as illustrated in FIGS. 5 and 6.

Figure 7:
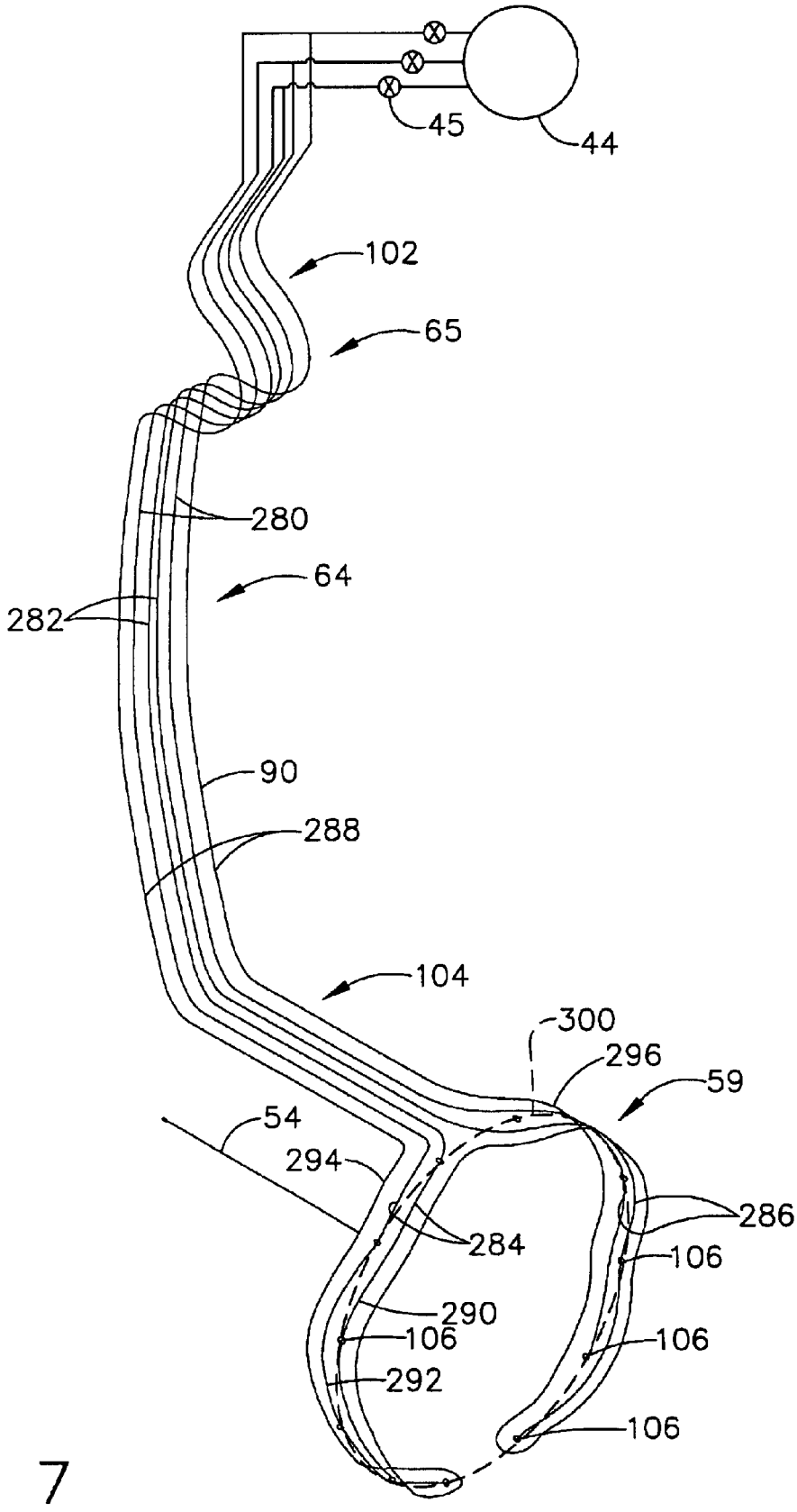
FIG. 7 is a schematic illustration of fuel circuits of the fuel injector in FIG. 1.

Referring to FIGS. 6, 7, and 8, the fuel circuits 102 include first and second main nozzle circuits 280 and 282 each of which include clockwise and counterclockwise extending annular legs 284 and 286, respectively, in the main nozzle 59. The spray orifices 106 extend from the annular legs 284 and 286 through one or both of the first and second plates 76 and 78. In the exemplary embodiment, the spray orifices 106 radially extend outwardly through the first plate 76 of the main nozzle 59 which is the radially outer one of the plates. The clockwise and counterclockwise extending annular legs 284 and 286 have parallel first and second waves 290 and 292, respectively. The spray orifices 106 are located in alternating ones of the first and second waves 290 and 292 so as to be substantially circularly aligned along a circle 300. The fuel circuits 102 also include a looped pilot nozzle circuit 288 which feeds the pilot nozzle extension 54. The looped pilot nozzle circuit 288 includes clockwise and counterclockwise extending annular pilot legs 294 and 296, respectively, in the main nozzle 59.

See U.S. Pat. No. 6,321,541 for information on nozzle assemblies and fuel circuits between bonded plates. Referring to FIGS. 2, 8, and 9, the internal fuel flow passages 90 down the length of the feed strips 62 are used to feed fuel to the fuel circuits 102. Fuel going into each of the internal fuel flow passages 90 in the feed strips 62 and the header 104 into the pilot and main nozzles 58 and 59 is controlled by fuel valves 45 illustrated by the inlet assembly 41 being part of the valve's housing and further illustrated schematically in FIG. 7. The header 104 of the nozzle assembly 12 receives fuel from the feed strips 62 and conveys the fuel to the main nozzle 59. The main nozzle 59 is annular and has a cylindrical shape or configuration. The flow passages, openings and various components of the spray devices in plates 76 and 78 can be formed in any appropriate manner such as by etching and, more specifically, chemical etching. The chemical etching of such plates should be known to those skilled in the art and is described for example in U.S. Pat. No. 5,435,884. The etching of the plates allows the forming of very fine, well-defined, and complex openings and passages, which allow multiple fuel circuits to be provided in the feed strips 62 and main nozzle 59 while maintaining a small cross-section for these components. The plates 76 and 78 can be bonded together in surface-to-surface contact with a bonding process such as brazing or diffusion bonding. Such bonding processes are well-known to those skilled in the art and provides a very secure connection between the various plates. Diffusion bonding is particularly useful as it results in grain boundary growth across an original bond interface between adjacent layers providing a mechanically good joint.

Referring to FIGS. 1, 3, and 4, each mixer assembly 40 includes a pilot mixer 142, a main mixer 144, and a centerbody 143 extending therebetween. The centerbody 143 defines a chamber 150 that is in flow communication with, and downstream from, the pilot mixer 142. The pilot nozzle 58 is supported by the centerbody 143 within the chamber 150. The pilot nozzle 58 is designed for spraying droplets of fuel downstream into the chamber 150. The main mixer 144 includes first and second main swirlers 180 and 182 located upstream from spray orifices 106. The pilot mixer 142 includes a pair of concentrically mounted pilot swirlers 160. In the illustrated embodiment of the invention, the swirlers 160 are axial swirlers and include an inner pilot swirler 162 and an outer pilot swirler 164. The inner pilot swirler 162 is annular and is circumferentially disposed around the pilot nozzle 58. Each of the inner and outer pilot swirlers 162 and 164 includes a plurality of inner and outer pilot swirling vanes 166 and 168, respectively, positioned upstream from pilot nozzle 58.

An annular pilot splitter 170 is radially disposed between the inner and outer pilot swirlers 162 and 164 and extends downstream from the inner and outer pilot swirlers 162 and 164. The pilot splitter 170 is designed to separate airflow traveling through inner pilot swirler 162 from airflow flowing through the outer pilot swirler 164. Splitter 170 has a converging-diverging inner surface 174 which provides a fuel-filming surface during engine low power operations. The splitter 170 also controls axial velocities of air flowing through the pilot mixer 142 to control recirculation of hot gases.

In one embodiment, the inner pilot swirler vanes 166 swirl air flowing therethrough in the same direction as air flowing through the outer pilot swirler vanes 168. In another embodiment, the inner pilot swirler vanes 166 swirl air flowing therethrough in a first circumferential direction that is opposite a second circumferential direction that the outer pilot swirler vanes 168 swirl air flowing therethrough.

The main mixer 144 includes an annular main housing 190 that defines an annular cavity 192. The main mixer 144 is concentrically aligned with respect to the pilot mixer 142 and extends circumferentially around the pilot mixer 142. The annular main nozzle 59 is circumferentially disposed between the pilot mixer 142 and the main mixer 144. More specifically, main nozzle 59 extends circumferentially around the pilot mixer 142 and is radially located between the centerbody 143 and the main housing 190.

The housing 190 includes inner and outer heat shields 194 and 196. The inner heat shield 194 includes inner and outer walls 202 and 204, respectively, and a 360 degree annular gap 200 therebetween. The inner and outer heat shields 194 and 196 each include a plurality of openings 206 aligned with the spray orifices 106. The inner and outer heat shields 194 and 196 are fixed to the stem 32 in an appropriate manner, such as by welding or brazing.

The main nozzle 59 and the spray orifices 106 inject fuel radially outwardly into the main mixer cavity 192 though the openings 206 in the inner and outer heat shields 194 and 196. An annular slip joint seal 208 is disposed in each set of the openings 206 in the inner heat shield 194 aligned with each one of the spray orifices 106 to prevent crossflow through the annular gap 200. The annular slip joint seal 208 is attached to the inner wall 202 of the inner heat shield 194 by a braze or other method. The annular slip joint seal 208 disposed in each of the openings 206 in the inner heat shield 194 to prevent crossflow through the annular gap 200 may be used with other types of fuel injectors.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A fuel injector conduit comprising:

a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, and said feed strip having a middle portion between said inlet end and said outlet end, said middle portion having a radius of curvature greater than a length of said middle portion.

2. The conduit as claimed in claim 1, wherein said feed strip has fuel inlet holes in said inlet end connected to said internal fuel flow passages.

3. The conduit as claimed in claim 1, wherein said feed strip has a bend between said outlet end and said middle portion.

4. The conduit as claimed in claim 3, further comprising an annular main nozzle fluidly connected to said outlet end of said feed strip and integrally formed with said feed strip from said single bonded together pair of lengthwise extending plates.

5. The conduit as claimed in claim 4, further comprising:

said internal fuel flow passages extending through said feed strip and said annular main nozzle, annular legs extending circumferentially from at least a first one of said internal fuel flow passages through said main nozzle, and spray orifices extending from said annular legs through at least one of said plates.

6. The conduit as claimed in claim 5, wherein said annular legs have waves.

7. The conduit as claimed in claim 6, further comprising a pilot nozzle circuit which includes clockwise and counterclockwise extending pilot legs extending circumferentially from at least a second one of said internal fuel flow passages through said main nozzle.

8. The conduit as claimed in claim 5, wherein said annular legs include clockwise and counterclockwise extending annular legs.

9. The conduit as claimed in claim 8, wherein said clockwise and counterclockwise extending annular legs have parallel first and second waves, respectively.

10. The conduit as claimed in claim 9, wherein said spray orifices are located in alternating ones of said first and second waves so as to be substantially aligned along a circle.

11. The conduit as claimed in claim 10, further comprising a pilot nozzle circuit which includes clockwise and counterclockwise extending pilot legs extending circumferentially from at least a second one of said internal fuel flow passages through said main nozzle.

12. (original) A fuel injector, comprising:

an upper housing;

a hollow stem depending from said housing;

at least one fuel nozzle assembly supported by said stem;

a fuel injector conduit extending between said housing through said stem to said nozzle assembly, said fuel injector conduit comprising a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, and said feed strip having a middle portion between said inlet end and said outlet end, said middle portion having a radius of curvature greater than a length of said middle portion.

13. The fuel injector as claimed in claim 12, wherein said feed strip has at least one acute bend between said inlet end and said middle portion and a bend between said outlet end and said middle portion.

14. The fuel injector as claimed in claim 13, wherein said feed strip has fuel inlet holes in said inlet end connected to said internal fuel flow passages.

15. The fuel injector as claimed in claim 14, wherein each of said internal fuel flow passages is connected to at least one of said inlet holes.

16. The fuel injector as claimed in claim 15, further comprising an annular main nozzle fluidly connected to said outlet end of said feed strip and integrally formed with said feed strip from said single bonded together pair of lengthwise extending plates.

17. The fuel injector as claimed in claim 16, further comprising:

said internal fuel flow passages extending through said feed strip and said annular main nozzle, annular legs extending circumferentially from at least a first one of said internal fuel flow passages through said main nozzle, and spray orifices extending from said annular legs through at least one of said plates.

18. The fuel injector as claimed in claim 17, wherein said annular legs have waves.

19. The fuel injector as claimed in claim 18, further comprising a pilot nozzle circuit which includes clockwise and counterclockwise extending pilot legs extending circumferentially from at least a second one of said internal fuel flow passages through said main nozzle.

20. The fuel injector as claimed in claim 18, wherein said annular legs have clockwise and counterclockwise extending annular legs have parallel first and second waves, respectively.

21. The fuel injector. as claimed in claim 20, wherein said spray orifices are located in alternating ones of said first and second waves so as to be substantially aligned along a circle.

22. The fuel injector as claimed in claim 21, further comprising a pilot nozzle circuit which includes clockwise and counterclockwise extending pilot legs extending circumferentially from at least a second one of said internal fuel flow passages through said main nozzle.

23. The injector as claimed in claim 22, further comprising:

a main mixer having an annular main housing with openings aligned with said spray orifices, an annular cavity defined within said main housing, said main nozzle received within said annular cavity, and an annular slip joint seal disposed in. each set of said openings aligned with each one of said the spray orifices.

24. The injector as claimed in claim 23, further comprising:

said housing including inner and outer heat shields, respectively, said inner heat shield including inner and outer walls and an annular gap therebetween, said openings passing through said inner and outer heat shields, and said annular slip joint seal attached to said inner wall of said inner heat shield.

25. A fuel injector comprising:

an annular main nozzle, a main mixer having an annular main housing with openings aligned with spray orifices in said main nozzle, an annular cavity defined within said main housing, said main nozzle received within said annular cavity, and an annular slip joint seal disposed in each set of said openings aligned with each one of said spray orifices.

26. The injector as claimed in claim 25, further comprising:

said housing including inner and outer heat shields, respectively, said inner heat shield including inner and outer walls and an annular gap therebetween, said openings passing through said inner and outer heat shields, and said annular slip joint seal attached to said inner wall of said inner heat shield.

27. A fuel injector conduit comprising:

a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, and said feed strip having a substantially straight radially extending middle portion between said inlet end and said outlet end.

28. The conduit as claimed in claim 27, wherein said feed strip has a bend between said outlet end and said middle portion.

29. The conduit as claimed in claim 28, further comprising a straight header fluidly connecting an annular main nozzle to said outlet end of said feed strip.

30. The conduit as claimed in claim 29, further comprising said straight header and said annular main nozzle being integrally formed with said feed strip from said single bonded together pair of lengthwise extending plates.

31. The conduit as claimed in claim 29, further comprising:

said internal fuel flow passages extending through said feed strip, said header, and said annular main nozzle, annular legs extending circumferentially from at least a first one of said internal fuel flow passages through said main nozzle, and spray orifices extending from said annular legs through at least one of said plates.

32. A fuel injector conduit comprising:

a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, said feed strip having a substantially straight middle portion between said inlet end and said outlet end, said feed strip having a bend between said outlet end and said middle portion, a straight header fluidly connecting an wherein said annular main nozzle to said outlet end of said feed strip, said straight header and said annular main nozzle being integrally formed with said feed strip from said single bonded together pair of lengthwise extending plates, said internal fuel flow passages extending through said feed strip, said header, and said annular main nozzle, annular legs extending circumferentially from at least a first one of said internal fuel flow passages through said main nozzle, spray orifices extending from said annular legs through at least one of said plates, and annular legs have waves.

33. The conduit as claimed in claim 32, further comprising a pilot nozzle circuit which includes clockwise and counterclockwise extending pilot legs extending circumferentially from at least a second one of said internal fuel flow passages through said main nozzle.

34. The conduit as claimed in claim 31, wherein said annular legs include clockwise and counterclockwise extending annular legs.

35. A fuel injector conduit comprising:

a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, said feed strip having a substantially straight middle portion between said inlet end and said outlet end, said feed strip having a bend between said outlet end and said middle portion, a straight header fluidly connecting an annular main nozzle to said outlet end of said feed strip, said straight header and said annular main nozzle being integrally formed with said feed strip from said single bonded together pair of lengthwise extending plates, said internal fuel flow passages extending through said feed strip, said header, and said annular main nozzle, annular legs extending circumferentially from at least a first one of said internal fuel flow passages through said main nozzle, spray orifices extending from said annular legs through at least one of said plates, and said annular legs including clockwise and counterclockwise extending annular legs having parallel first and second waves, respectively.

36. The conduit as claimed in claim 35, wherein said spray orifices are located in alternating ones of said first and second waves so as to be circularly aligned and distributed about an axis of revolution about which said main nozzle is circumscribed.

37. The conduit as claimed in claim 36, further comprising a pilot nozzle circuit which includes clockwise and counterclockwise extending pilot legs extending circumferentially from at least a second one of said internal fuel flow passages through said main nozzle.

38. A fuel injector, comprising:

an upper housing;

a hollow stem depending from said housing;

at least one fuel nozzle assembly supported by said stem;

a fuel injector conduit extending between said housing through said stem to said nozzle assembly, said fuel injector conduit comprising a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, and said feed strip having a substantially straight middle portion extending radially through the entire radial length of the stem.

39. The fuel injector as claimed in claim 38, wherein said feed strip has at least one acute bend between said inlet end and said middle portion and a bend between said outlet end and said middle portion.

40. The fuel injector as claimed in claim 39, further comprising a straight header fluidly connecting an annular main nozzle to said outlet end of said feed strip.

41. The fuel injector as claimed in claim 40, further comprising said header, said main nozzle, and said feed strip being integrally formed from said single bonded together pair of lengthwise extending plates.

42. The fuel injector as claimed in claim 41, further comprising:

said internal fuel flow passages extending through said feed strip and said annular main nozzle, annular legs extending circumferentially from at least a first one of said internal fuel flow passages through said main nozzle, and spray orifices extending from said annular legs through at least one of said plates.

43. A fuel injector, comprising:

an upper housing;

a hollow stem depending from said housing;

at least one fuel nozzle assembly supported by said stem;

a fuel injector conduit extending between said housing through said stem to said nozzle assembly, said fuel injector conduit comprising a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, said feed strip having a substantially straight middle portion between said inlet end and said outlet end, said feed strip having at least one acute bend between said inlet end and said middle portion and a bend between said outlet end and said middle portion, a straight header fluidly connecting an annular main nozzle to said outlet end of said feed strip.

said header, said main nozzle, and said feed strip being integrally formed from said single bonded together pair of lengthwise extending plates, said internal fuel flow passages extending through said feed strip and said annular main nozzle, annular legs extending circumferentially from at least a first one of said internal fuel flow passages through said main nozzle, spray orifices extending from said annular legs through at least one of said plates, and said annular legs having waves.

44. The fuel injector as claimed in claim 43, further comprising a pilot nozzle circuit which includes clockwise and counterclockwise extending pilot legs extending circumferentially from at least a second one of said internal fuel flow passages through said main nozzle.

45. A fuel injector, comprising:

an upper housing;

a hollow stem depending from said housing;

at least one fuel nozzle assembly supported by said stem;

a fuel injector conduit extending between said housing through said stem to said nozzle assembly, said fuel injector conduit comprising a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, said feed strip having a substantially straight middle portion between said inlet end and said outlet end, said feed strip having at least one acute bend between said inlet end and said middle portion and a bend between said outlet end and said middle portion, a straight header fluidly connecting an annular main nozzle to said outlet end of said feed strip, said header, said main nozzle, and said feed strip being integrally formed from said single bonded together pair of lengthwise extending plates, said internal fuel flow passages extending through said feed strip and said annular main nozzle, annular legs extending circumferentially from at least a first one of said internal fuel flow passages through said main nozzle, spray orifices extending from said annular legs through at least one of said plates, said annular legs having clockwise and counterclockwise extending annular legs with parallel first and second waves respectively, and said spray orifices being located in alternating ones of said first and second waves so as to be substantially aligned along a circle.

46. The fuel injector as claimed in claim 45, further comprising a pilot nozzle circuit which includes clockwise and counterclockwise extending pilot legs extending circumferentially from at least a second one of said internal fuel flow passages through said main nozzle.

47. The injector as claimed in claim 46, further comprising:

a main mixer having an annular main housing with openings aligned with said spray orifices, an annular cavity defined within said main housing, and said main nozzle received within said annular cavity.

48. A fuel injector, comprising:

an upper housing;

a hollow stem depending from said housing;

at least one fuel nozzle assembly supported by said stem;

a fuel injector conduit extending between said housing through said stem to said nozzle assembly, said fuel injector conduit comprising a single feed strip having a single bonded together lair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, said feed strip having a substantially straight middle portion between said inlet end and said outlet end, a bend between said outlet end and said middle portion, a straight header fluidly connecting an annular main nozzle to said outlet end of said feed strip, said conduit having a number of bending arms and respective number of bending arm lengths, said straight header being one of said bending arms, a thickness of said strip, and a peak concentrated allowable bending stress omax, a design hot metal temperature of said stem, and a design cold metal temperature of the feed strip, said bending arm lengths satisfy the following equation;

$$\sigma\mathrm{MAX} \geq \frac{3xL1xExHxLTGx(THx\alpha H - TCx\alpha C)}{2x(L_1^3 + L_2^3 + \ldots\ LN^3)}$$

wherein E equals Young's Modulus.

49. The conduit as claimed in claim 48, further comprising said straight header and said annular main nozzle being integrally formed with said feed strip from said single bonded together pair of lengthwise extending plates.

50. The conduit as claimed in claim 49, further comprising said feed strip having a middle portion between said inlet end and said outlet end, said middle portion having a radius of curvature greater than a length of said middle portion.

51. The conduit as claimed in claim 50, further comprising:

said internal fuel flow passages extending through said feed strip, said header, and said annular main nozzle, annular legs extending circumferentially from at least a first one of said internal fuel flow passages through said main nozzle, and spray orifices extending from said annular legs through at least one of said plates.

52. The conduit as claimed in claim 51, wherein said annular legs have waves.

53. The conduit as claimed in claim 52, further comprising a pilot nozzle circuit which includes clockwise and counterclockwise extending pilot legs extending circumferentially from at least a second one of said internal fuel flow passages through said main nozzle.

54. The conduit as claimed in claim 51, wherein said annular legs include clockwise and counterclockwise extending annular legs.

55. The conduit as claimed in claim 54, wherein said clockwise and counterclockwise extending annular legs have parallel first and second waves, respectively.

56. The conduit as claimed in claim 55, wherein said spray orifices are located in alternating ones of said first and second waves so as to be circularly aligned and distributed about an axis of revolution about which said main nozzle is circumscribed.

57. A fuel injector conduit comprising:

a single feed strip having a single bonded together pair of lengthwise extending plates, each of said plates having a single row of widthwise spaced apart and lengthwise extending parallel grooves, said plates being bonded together such that opposing grooves in each of said plates are aligned forming internal fuel flow passages through the length of said strip from an inlet end to an outlet end, and said feed strip having a middle portion between said inlet end and said outlet end, said middle portion being substantially straight and slightly bowed and having a radius of curvature greater than a length of said middle portion.

58. The conduit as claimed in claim 57, wherein said feed strip has a bend between said outlet end and said middle portion.

59. The conduit as claimed in claim 58, further comprising a straight header fluidly connecting an annular main nozzle to said outlet end of said feed strip.

60. The conduit as claimed in claim 59, further comprising said straight header and said annular main nozzle being integrally formed with said feed strip from said single bonded together pair of lengthwise extending plates.

61. The conduit as claimed in claim 59, further comprising:

said internal fuel flow passages extending through said feed strip, said header, and said annular main nozzle, annular legs extending circumferentially from at least a first one of said internal fuel flow passages through said main nozzle, and spray orifices extending from said annular legs through at least one of said plates.

62. The conduit as claimed in claim 61, wherein said annular legs have waves.

63. The conduit as claimed in claim 62, further comprising a pilot nozzle circuit which includes clockwise and counterclockwise extending pilot legs extending circumferentially from at least a second one of said internal fuel flow passages through said main nozzle.

64. The conduit as claimed in claim 61, wherein said annular legs include clockwise and counterclockwise extending annular legs.

65. The conduit as claimed in claim 64, wherein said clockwise and counterclockwise extending annular legs have parallel first and second waves, respectively.

66. The conduit as claimed in claim 65, wherein said spray orifices are located in alternating ones of said first and second waves so as to be circularly aligned and distributed about an axis of revolution about which said main nozzle is circumscribed.

67. The conduit as claimed in claim 66, further comprising a pilot nozzle circuit which includes clockwise and counterclockwise extending pilot legs extending circumferentially from at least a second one of said internal fuel flow passages through said main nozzle.

* * * * *